US009545551B1

(12) United States Patent
Dinoffer

(10) Patent No.: US 9,545,551 B1
(45) Date of Patent: Jan. 17, 2017

(54) NET AND FRAME ASSEMBLIES FOR NET AND WALL GAMES

(71) Applicant: Joe Dinoffer, Dallas, TX (US)

(72) Inventor: Joe Dinoffer, Dallas, TX (US)

( * ) Notice: Subject to any disclaimer, the term of this patent is extended or adjusted under 35 U.S.C. 154(b) by 71 days.

(21) Appl. No.: 14/660,832

(22) Filed: Mar. 17, 2015

Related U.S. Application Data

(60) Provisional application No. 62/050,086, filed on Sep. 13, 2014, provisional application No. 62/074,128, filed on Nov. 3, 2014.

(51) Int. Cl.
*A63B 61/02* (2006.01)

(52) U.S. Cl.
CPC ..... *A63B 61/02* (2013.01)

(58) Field of Classification Search
CPC ..... A63B 61/00; A63B 61/003; A63B 61/02; A63B 61/04
See application file for complete search history.

(56) References Cited

U.S. PATENT DOCUMENTS 401,082 A * 4/1889 Taylor ..... A63B 61/04 473/495
3,549,146 A * 12/1970 Davis ..... A63B 61/04 473/474
3,998,455 A * 12/1976 Billmeyer ..... A63B 61/02 473/493
4,010,951 A * 3/1977 Gronlund ..... A63B 61/02 473/492
4,247,099 A * 1/1981 Pandak ..... A63B 61/04 33/755
4,274,632 A * 6/1981 Jacobs ..... A63B 61/02 473/492
5,816,956 A * 10/1998 Ellis ..... A63B 61/00 473/490
5,855,527 A * 1/1999 Koole ..... A63B 61/02 473/493
6,030,301 A * 2/2000 Asada ..... A63B 61/02 473/492
6,716,123 B1 * 4/2004 Chen ..... A63B 61/00 473/490
2007/0087869 A1 * 4/2007 Lin ..... A63B 61/003 473/490
2011/0287873 A1 * 11/2011 Chen ..... A63B 61/02 473/492
2014/0135153 A1 * 5/2014 Wartenweiler ..... A63B 61/00 473/478
2015/0057109 A1 * 2/2015 Chen ..... A63B 61/02 473/416
2015/0283439 A1 * 10/2015 Goldstein ..... A63B 61/04 473/493

* cited by examiner

*Primary Examiner* — Raleigh W Chiu
(74) *Attorney, Agent, or Firm* — Jeffrey Roddy

(57) ABSTRACT

An easily assembled and disassembled frame for a net game includes a rigid multi-part frame with a cross-member that is non-sagging. Sections of the multi-part frame have an elliptical profile. A net stabilizer includes a tensioning member coupled at one end to a retention member of the frame, and having the other end of the tensioning member inserted into a center sleeve of the net, and, a center sleeve with a securing member for fastening securely at one end to the cross-member.

3 Claims, 8 Drawing Sheets

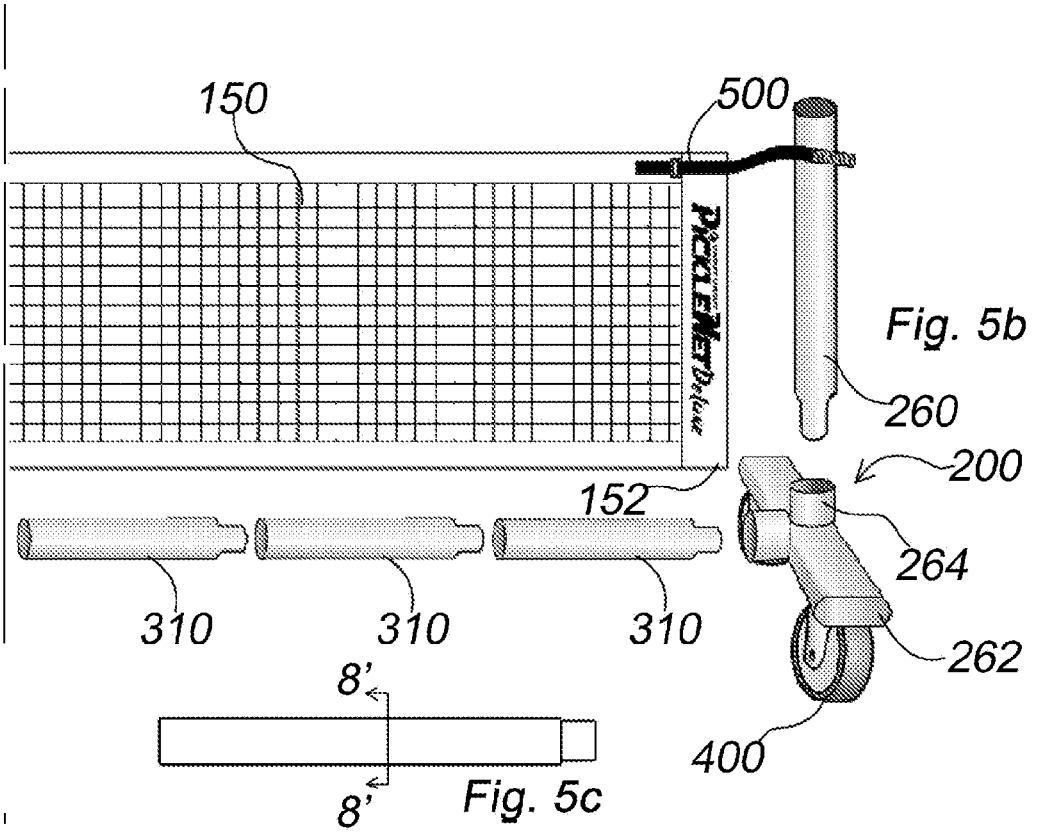
Fig. 5b
Fig. 5c
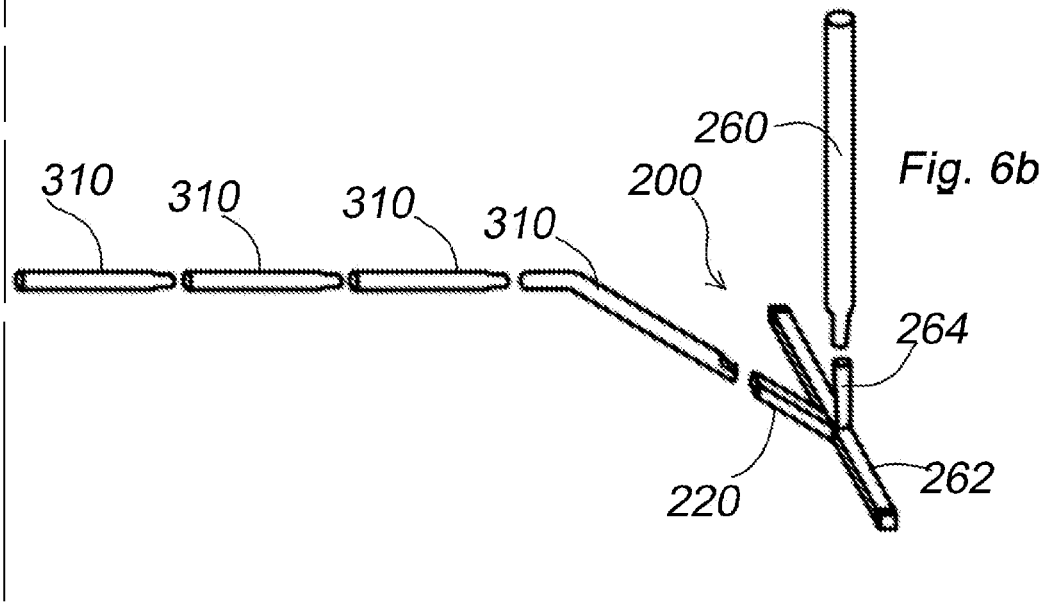
Fig. 6b

NET AND FRAME ASSEMBLIES FOR NET AND WALL GAMES

CROSS-REFERENCE TO RELATED APPLICATIONS

This Application claims the benefit of U.S. Provisional Application 62/050,086 filed Sep. 13, 2014 and titled: NET AND FRAME ASSEMBLIES FOR PICKLEBALL and U.S. Provisional Application 62/074,128 titled: NET AND FRAME ASSEMBLIES FOR NET AND WALL GAMES filed Nov. 3, 2014.

FIELD OF THE INVENTION

The present invention relates generally to a rapid assembly portable net system adaptable for use with net and wall games.

BACKGROUND

Portable net supports of various types are long known in the art. Such supports can typically be categorized according to the degree of portability and to the degree the support structure disassembles. Some support systems possess a pair of relatively heavy movable posts mounted atop bases which are simply rolled out of the way when not in use, while others are of lighter construction, disassemble into smaller more numerous elements, and may be transported by one person. While assembly methods for the supporting structures vary, conventionally, the frame includes upright posts over which an end of a net is placed and a spacer between the net and the ground which is connected at its ends to portions of the upright posts. One problem of portable net structures is the tendency of the net to sag, particularly in the middle due to insufficient frame rigidity, which may also cause the upright posts to shift during play. Another problem is the tendency of connecting assembly members to misalign; i.e., twist over time, or, ill-fitting inter-connectable parts that make assembly burdensome.

SUMMARY

The present invention addresses the shortcomings of former net supports by providing a net support system which is easily and quickly assembled and disassembled, eliminating problems with fit and orientation of various structural elements. The assembly includes a rigid, yet readily portable frame that prevents undesired sagging of the supported net. The embodiments described herein possess at least (1) a pair of end-post sub-assemblies including inter-connectable tubular segments that support a cross bar and a net therebetween, (2) a series of tubular spacers possessing an elliptical profile, and which are inter-connectable to form a cross bar sub-assembly that at its ends is reversibly connectable to the end post assemblies, (3) a pair of vertical posts which are reversibly connectable to the end-post sub-assemblies, (4) a net for attachment to the extendable posts, and (5) a center support member for supporting or adjusting the height of the mid-section of the net. It will be appreciated by those having skill in the art that certain objects and features described herein allow the present invention to perform well with a variety of so-called "net and wall" games.

In some embodiments, while the connection means for connecting a vertically extendable post to each end-post sub-assembly is preferably shown in the embodiment as a stub for coupling to one end of a vertical post which is placed over or inserted into the stub, other coupling means will be appreciated by those skilled in the art.

In various embodiments, a cross-bar sub-assembly is comprised of connectable segments or spacers 310 of metal channel or rigid plastic tubing/channel that may or may not have a shielded shock cord running therethrough to assist in the retention and orientation of the segments. If a shock cord is employed, shielding is provided by flexible tubing about the shock cord whether a unitary length of tubing, or multiple abutting sections of tubing applied to the exterior of the shock cord to prevent the shock cord from abrading.

In various embodiments, a frame assembly 100 includes a mid-frame sub-assembly 270 that includes a support and retainer for a tensioned member 160 which is typically a sufficiently rigid rod or the like placed inside a center sleeve 154 of the net 150 so as to keep the mid-section of the net stiff, and at a desired height; i.e., without sagging or creases. Sub-assembly 270 may also include a means for elongating or adjusting the tension to increase tension on the mid-section of the net. A retainer may be a cup 273 or tubular segment that has space within for supporting a lower end of a tensioning member. The retainer may include a height adjustment means such as a threaded portion; e.g., either male or female threads mated respectively to a threaded recess or threaded shaft similar to a screw jack whereby the cup is raised or lowered by turning. In some embodiments a lower end of the tensioning member is inserted into the retainer that can be a cup, a sleeve or section of tubing or channel, which is mounted to the mid-frame assembly and adapted to permit the tensioning member to slide within. The retainer may include a transversely positioned set screw (FIG. 7) that when tightened, fixes the tensioning member in a desired position or height within in the retainer. In some embodiments, it is contemplated that spacers may be placed under the lower end of the tensioning member. The strap may have an opening to permit the insertion of the tensioning member and a securing means such as a flap about the opening that connects to the cup with mating hook and loop material, or a grommet to secure the flap and thus the strap to the cross-member.

In various embodiments, the series of spacers 310 may possess an elliptical transverse cross-section; i.e., profile, and wherein ends of the spacers 310 are alternately narrow and wide, or crimped and uncrimped so as to mate end-to-end; e.g., narrow to wide, crimped to untrimmed, or male to female to produce a friction fit when mated. The mating ends of the spacers may include rubber gaskets or liners about an annulus of the spacer to provide additional friction or snug fit. The spacers may also include spring button clips or other retention and alignment elements used where a portion of one tube overlaps another to to secure the tubes together, or eliminate guesswork related to fit and alignment. The elliptical tubing of the cross-member has been found to be rigid, self aligning during assembly, and will not twist, rotate or axially shift during play.

The foregoing and other objects, features, and advantages of the invention will become more apparent from the following detailed description, which proceeds with reference to the accompanying figures where scale is approximate, and certain objects and features are shown enlarged for purposes of conciseness and clarity.

BRIEF DESCRIPTION OF THE DRAWINGS

FIG. 5*b* is a partial side view of the right side of the apparatus shown partially in (FIG. 5*a*);

FIG. 5*c* in one embodiment is a top plan view of a single spacer;

FIG. 6*b* is a partial side view of the right side of the apparatus shown partially in (FIG. 6*a*);

DETAILED DESCRIPTION OF THE INVENTION

Reference Listing: z

Figure 1A:
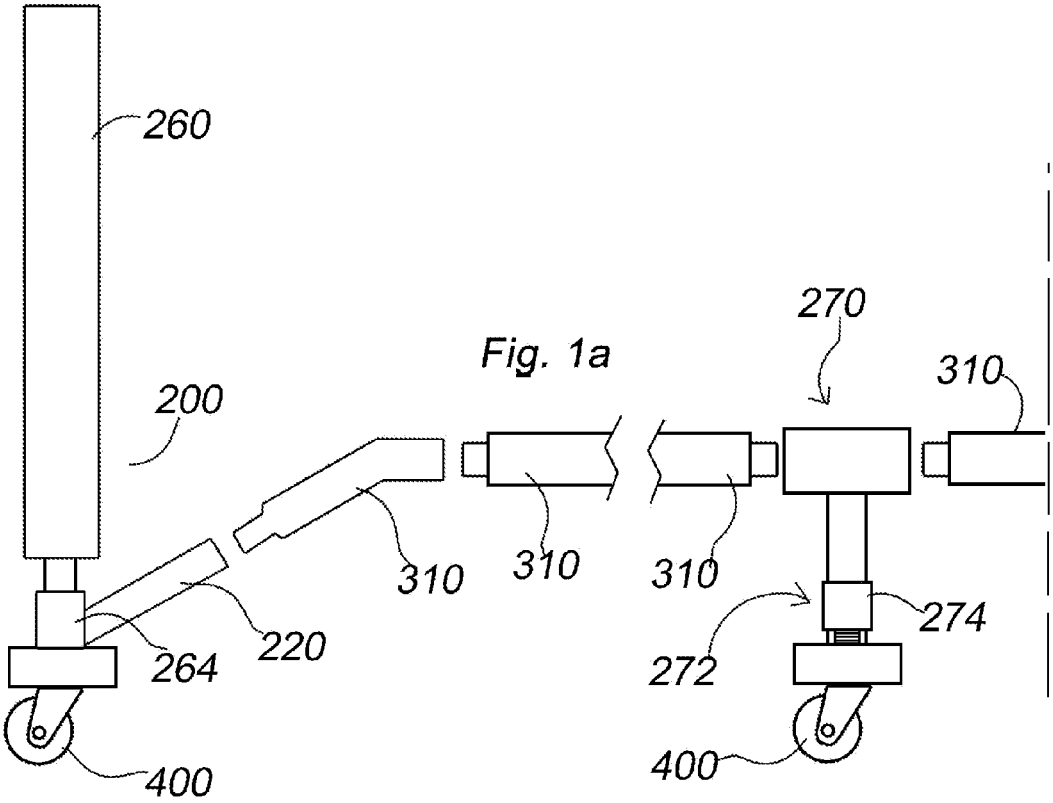
FIG. 1*a* is a partial side view of one embodiment taken from the left side of the apparatus.

100 net assembly frame
150 net
152 net sleeve
154 center sleeve
156 strap
158 net bottom band
160 tensioning member
200 end-post assembly
220 cross bar connector/riser
260 post
262 post foot
264 post connector
270 mid-frame sub-assembly
272 net tensioner support
274 cup
310 spacer segment
400 caster
500 strap

DEFINITIONS

In the following description, the term "net" refers to any type of net for sporting or recreational use which is sized and shaped for reversible attachment to the posts. Unless otherwise explained, any technical terms used herein have the same meaning as commonly understood by one of ordinary skill in the art to which this disclosure belongs. The singular terms "a" "an" and "the" include plural referents unless the context clearly indicates otherwise. Similarly, the word "or" is intended to include "and" unless the context clearly indicates otherwise. Although methods and materials similar or equivalent to those described herein can be used in the practice or testing of this disclosure, suitable methods and materials are described below. The term "comprises" means "includes." All publications, patent applications, patents, and other references mentioned herein are incorporated by reference in their entirety for all purposes. In case of inflict, the present specification, including explanations of terms, will control. In addition, the materials, methods, and examples are illustrative only and not intended to be limiting.

Referring generally to FIGS. 1-8, a portable net support system with tensioning adjustment for a supported net 100 includes a pair of end-post assemblies 200, posts 260 attachable to the end-post assemblies, a series of spacers 310 connected between the end-post assemblies, wherein the spacers possess a substantially elliptical transverse cross-section, and a mid-frame sub-assembly 270. The particular length and number of spacers may vary depending on the particular implementation.

Figure 1B:
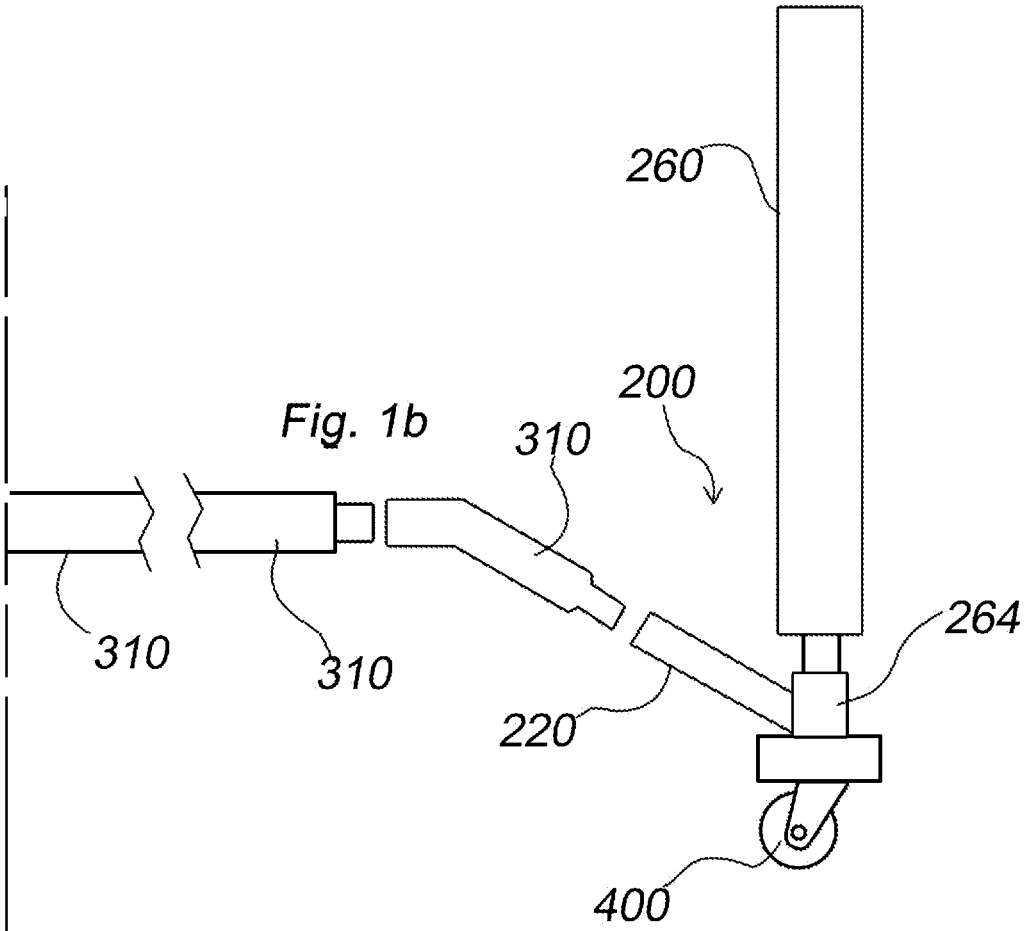
FIG. 1*b* is a partial side view of the right side of the apparatus shown partially in (FIG. 1*a*)

FIGS. 1*a* and 1*b* show respectively in left and right side views, an embodiment of a net support system with end-post assemblies 200, a connector 220, a series of spacers 310 forming a cross-member, and a mid-frame sub-assembly 270 that possesses a net tensioner support 272. The frame assembly as shown in the exploded view depicts a simplified arrangement and an exemplary number of spacers. The number of spacers and the respective lengths and proportions of the spacers may vary. The end posts 260 may vary in length width or diameter. While the particular embodiment depicted has casters 400, other embodiments may lack casters, or may be adapted to receive casters.

Figure 2A:
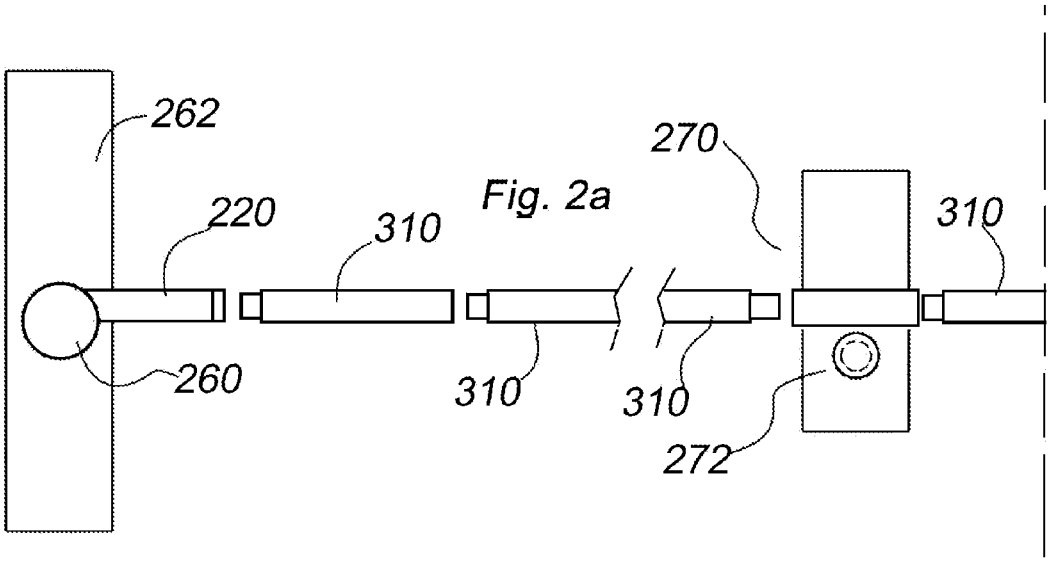
FIG. 2*a* is a partial top view of one embodiment taken from the left side of the apparatus.
Figure 2B:
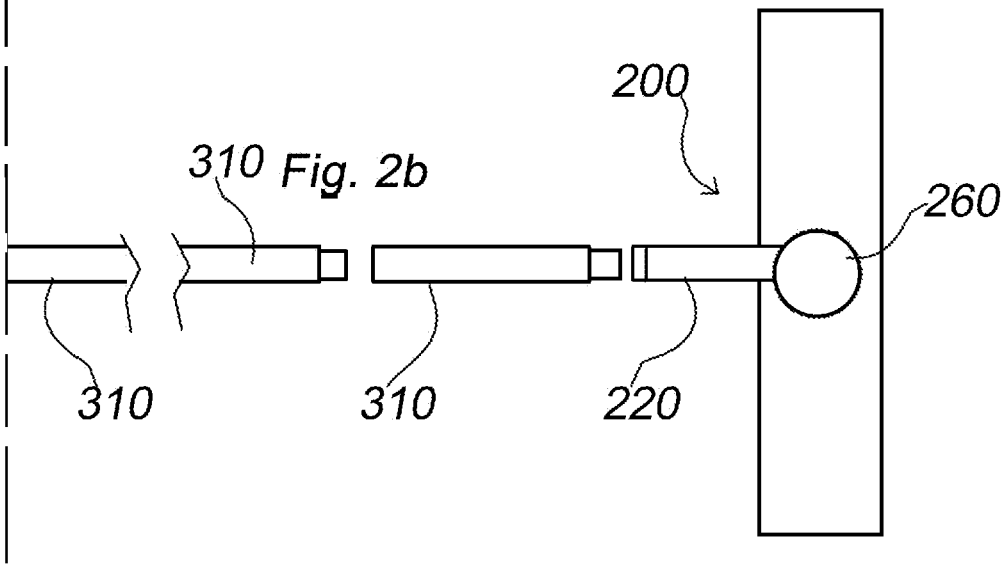
FIG. 2*b* is a partial top view of the right side of the apparatus shown partially in (FIG. 2*a*)

FIGS. 2*a* and 2*b* show respectively in left and right top down views, an embodiment of a net support system with end-post assemblies 200, a connector 220, a series of spacers 310 forming a cross-member, and a mid-frame sub-assembly 270 that possesses a net tensioner support 272. The frame assembly as shown in the exploded view depicts a simplified arrangement and an exemplary number of spacers. The number of spacers and the respective lengths and proportions of the spacers may vary.

Figure 3A:
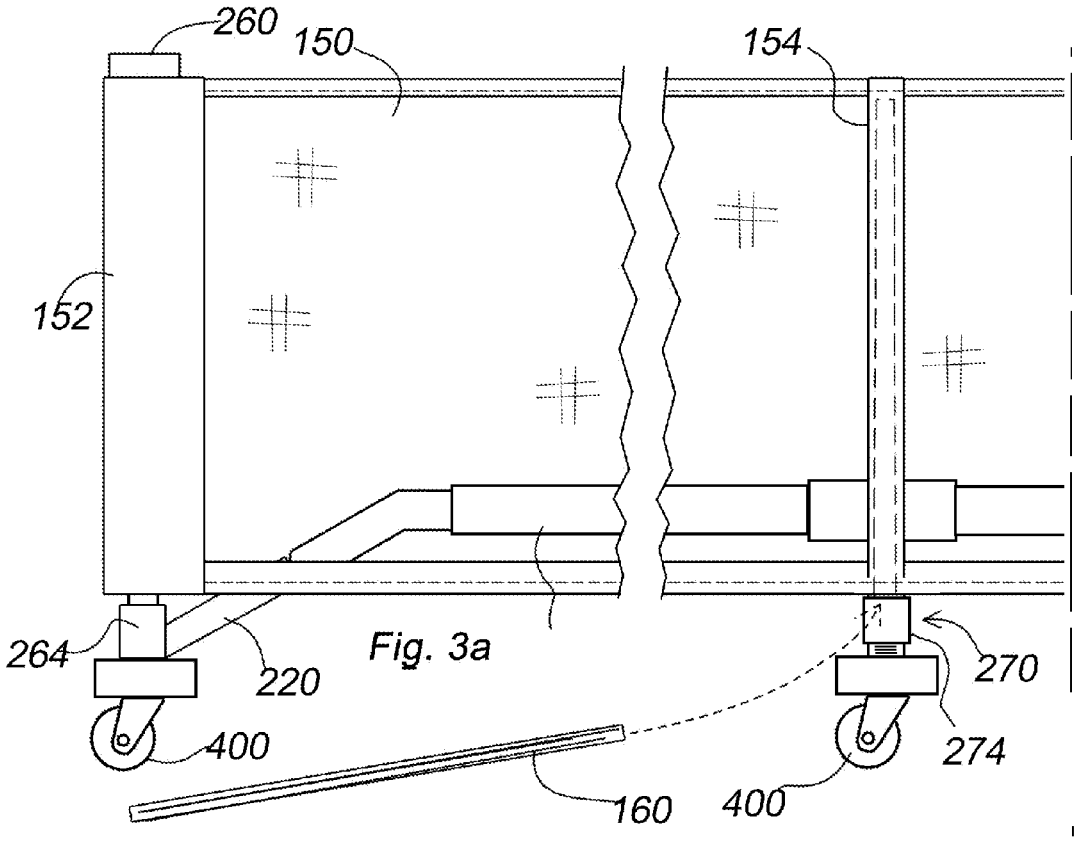
FIG. 3*a* is a partial side view of one embodiment taken from the left side of the apparatus.
Figure 3B:
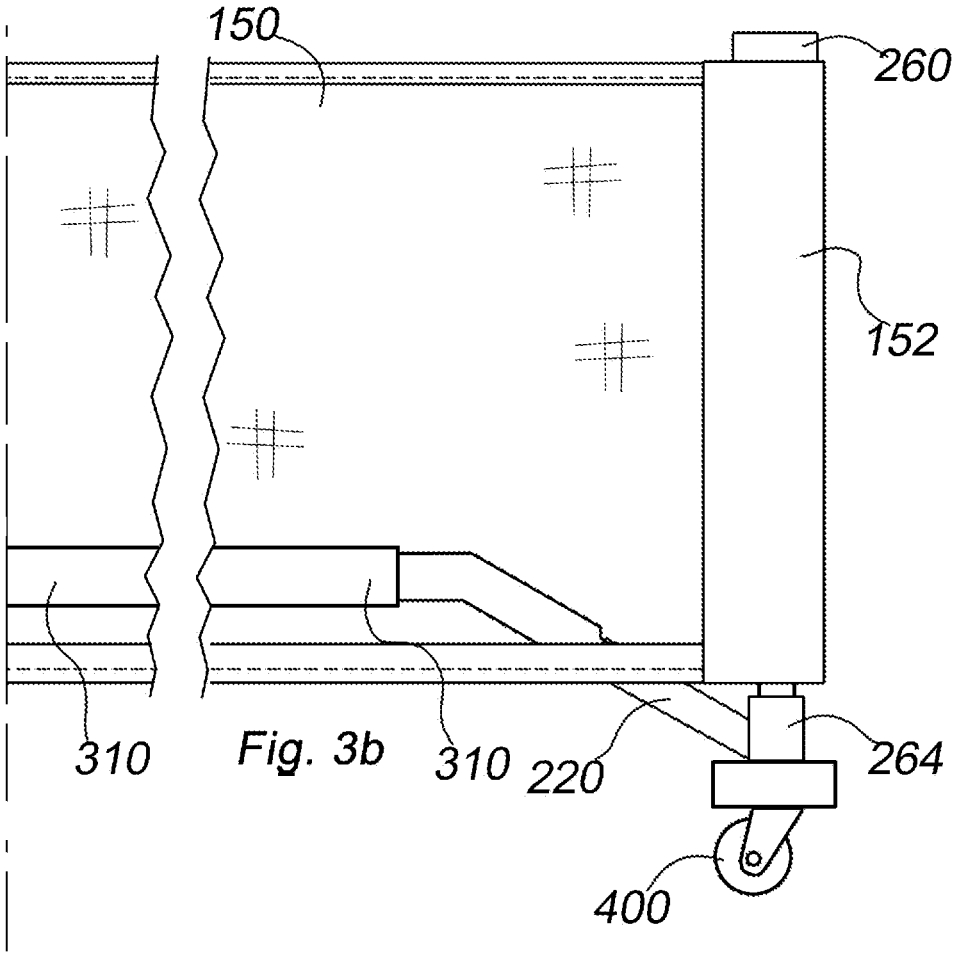
FIG. 3*b* is a partial side view of the right side of the apparatus shown partially in (FIG. 3*a*)
Figure 4B:
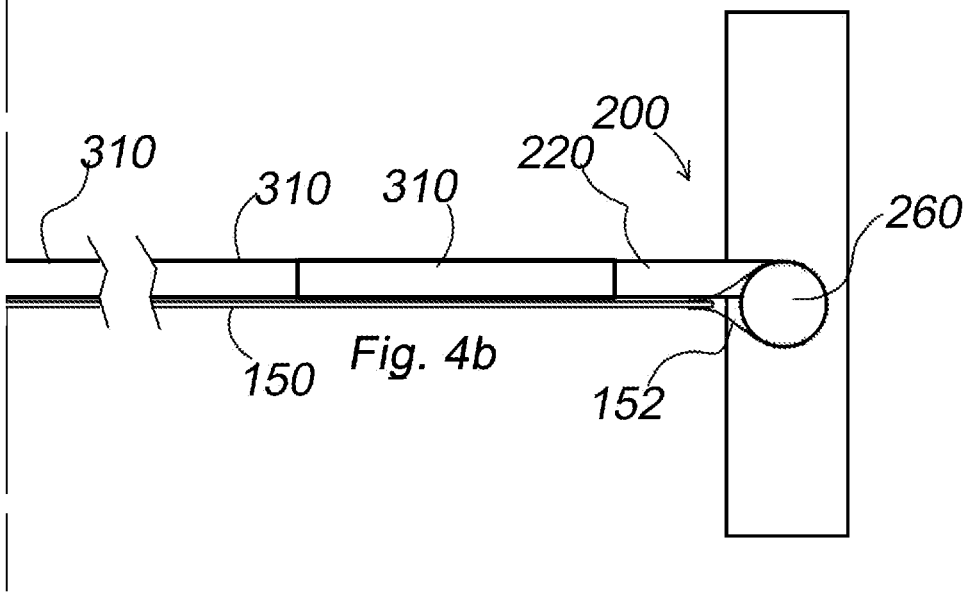
FIG. 4*b* is a partial top down view from the right side of the apparatus shown partially in (FIG. 4*a*)

FIGS. 3*a* and 3*b* show respectively in left and right side views, an embodiment of an assembled net support system with end-post assemblies 200, end posts 260, connector 220, a series of spacers 310 forming a cross-member, and a mid-frame sub-assembly 270 that possesses a net tensioner support 272. The embodiment depicted has a net 150 having end sleeves 152 that are placed over the end posts 260. Also shown is a center sleeve 154 as part of the net 150 that is adapted to receive a tensioning rod 160 therein to stiffen the center portion of the net. One end of the tensioning rode 160 fits into cup 274 that may be adjusted in an up or down direction to move the tensioning rod up to increase upward forced on the center portion of the net, or down to relieve tensioning on the net.

Figure 4A:
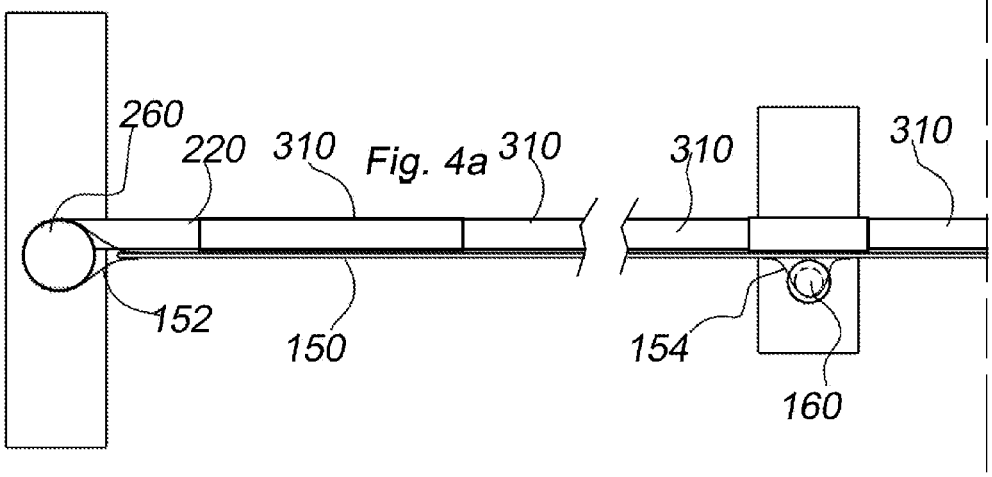
FIG. 4*a* is a partial top down view of one embodiment taken from the left side of the apparatus.

FIGS. 4*a* and 1*b* show respectively in left and right top down views, an embodiment of an assembled net support system with end-post assemblies 200, an installed net 150 having end sleeves 152 placed over the end posts 260, connector 220, a series of spacers 310 forming a cross-member, and a mid-frame sub-assembly 270 that possesses a net tensioner support 272 with cup 274.

Figure 5A:
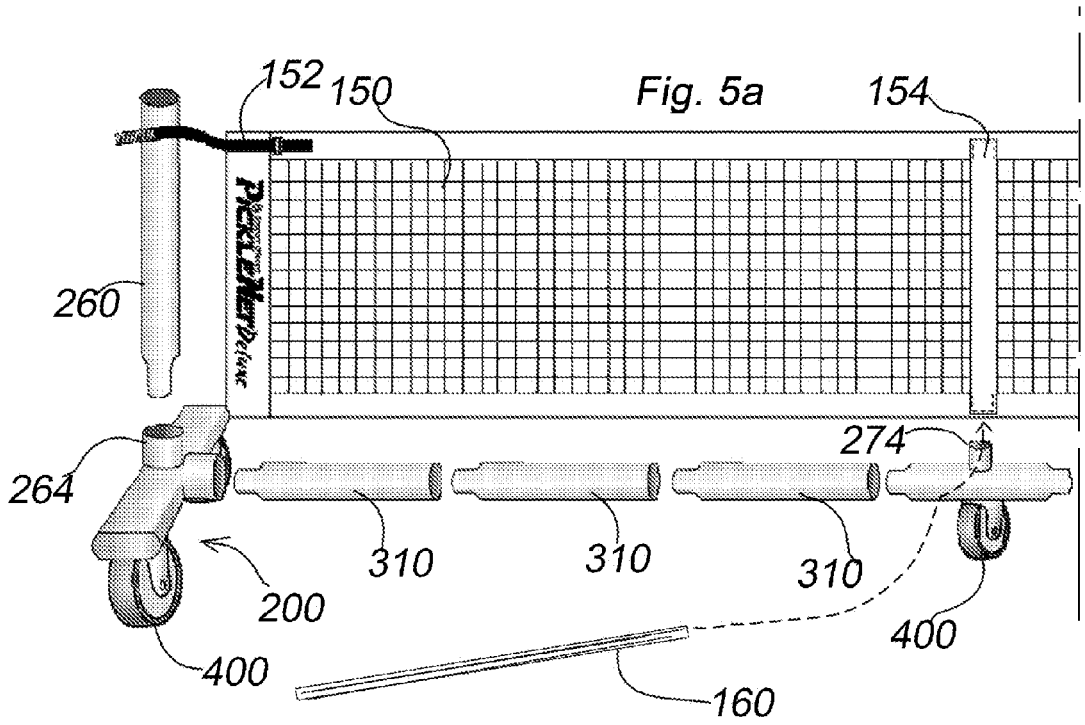
FIG. 5*a* is a partial side view of one embodiment taken from the left side of the apparatus.

FIGS. 5*a* and 5*b* show respectively in left and right side views, another embodiment of an assembled net support system with end-post assemblies 200, end posts 260, a connector 220, a series of spacers 310 forming a cross-member, and a mid-frame sub-assembly 270 that possesses a net tensioner support 272. The particular embodiment depicted has a net 150 having end sleeves 152 that are placed over the end posts 260. Also shown is a center sleeve 154 as part of the net 150 that is adapted to receive a tensioning rod 160 therein to stiffen the center portion of the net. One end of the tensioning rode 160 fits into cup 274 that may be cylindrical member welded to the mid-frame sub-assembly, and may or may not permit height adjustment of the rod 160 in an up or down direction to increase or decrease upward force on the center portion of the net.

Figure 6A:
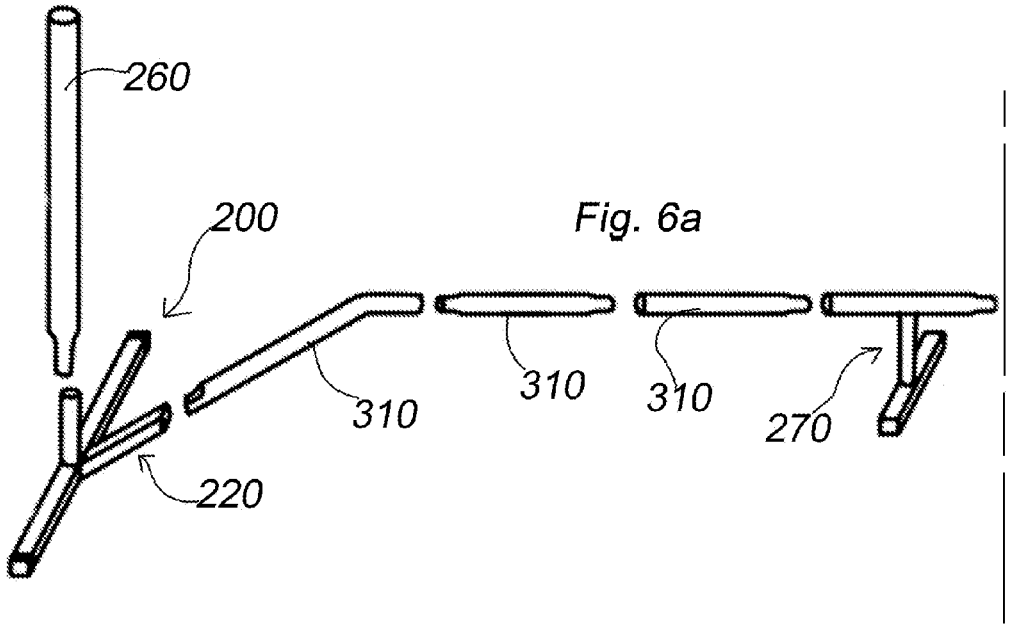
FIG. 6*a* is a partial side view of one embodiment taken from the left side of the apparatus.
Figure 7:
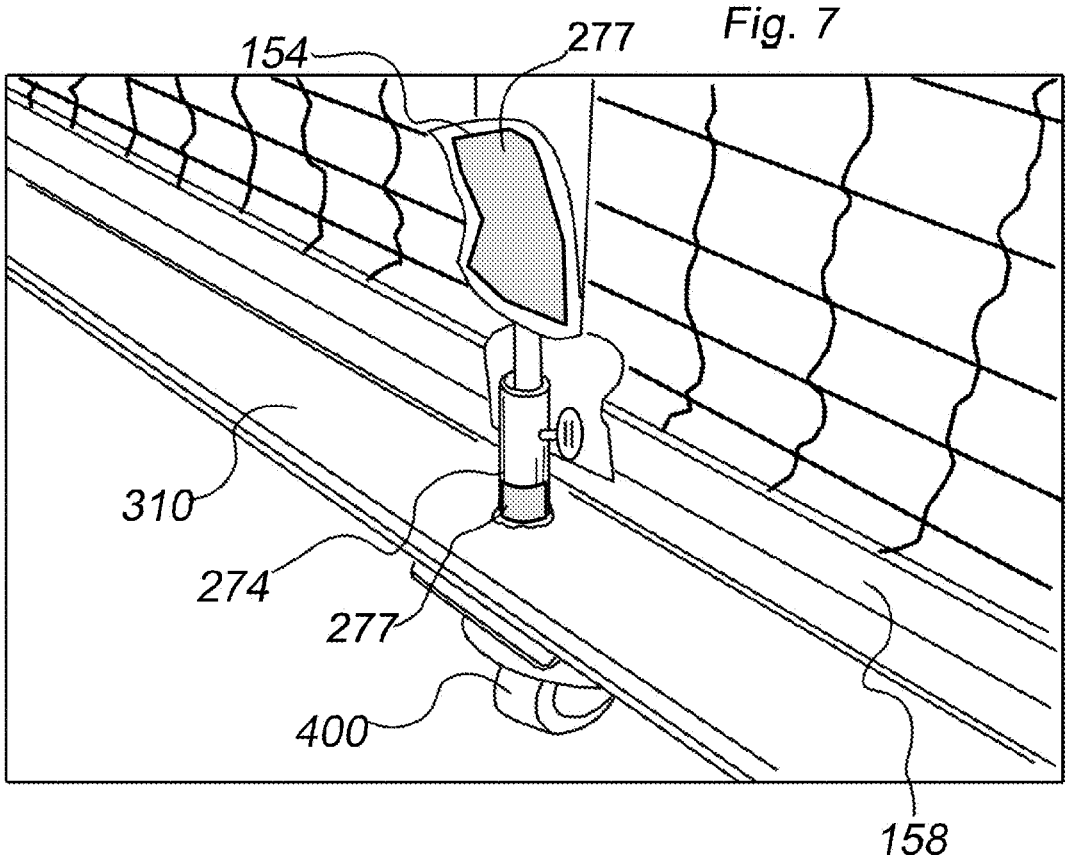
FIG. 7 is a perspective view of one embodiment showing a frame mid-section with retention and support member for a tensioning member and net tensioning strap 500.

FIGS. 6*a* and 6*b* show respectively in left and right side top down views, another embodiment of an assembled net support system with end-post assemblies 200, end posts 260, a connector 220, a series of spacers 310 forming a cross-member, and a mid-frame sub-assembly 270.

In various embodiments herein, adjustment of tensioning rod 160 position within center sleeve 154 may be accomplished by placing spacers (not shown) between the rod end and the inside of cup 274, or, in cases where the cup is fitted to a threaded post; turning the cup to raise or lower it (not shown), or, substituting a tube (see FIG. 7) as part of the mid-frame sub-assembly 270 which is adapted to receive one end of the rod and employs a set screw that when tightened, arrests the movement of the rod so as to fix it in place to obtain a desired amount of net tension or center net height. Rod tensioning means shown in the multiple embodiments herein are merely exemplary.

Other rod tensioning means will suggest themselves to those having skill in the art and benefit of this disclosure. It should be understood that the specific elements, features and objects of the various embodiments described herein may be interchanged, shared or substituted among the various embodiments without departing from the scope of the invention.

Figure 8:
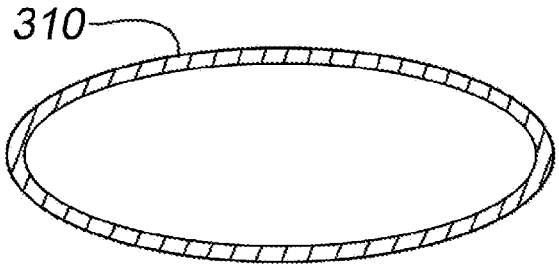
FIG. 8 is an enlarged cross-sectional view taken along lines 8'-8' of (FIG. 5*c*)
Figure 9:
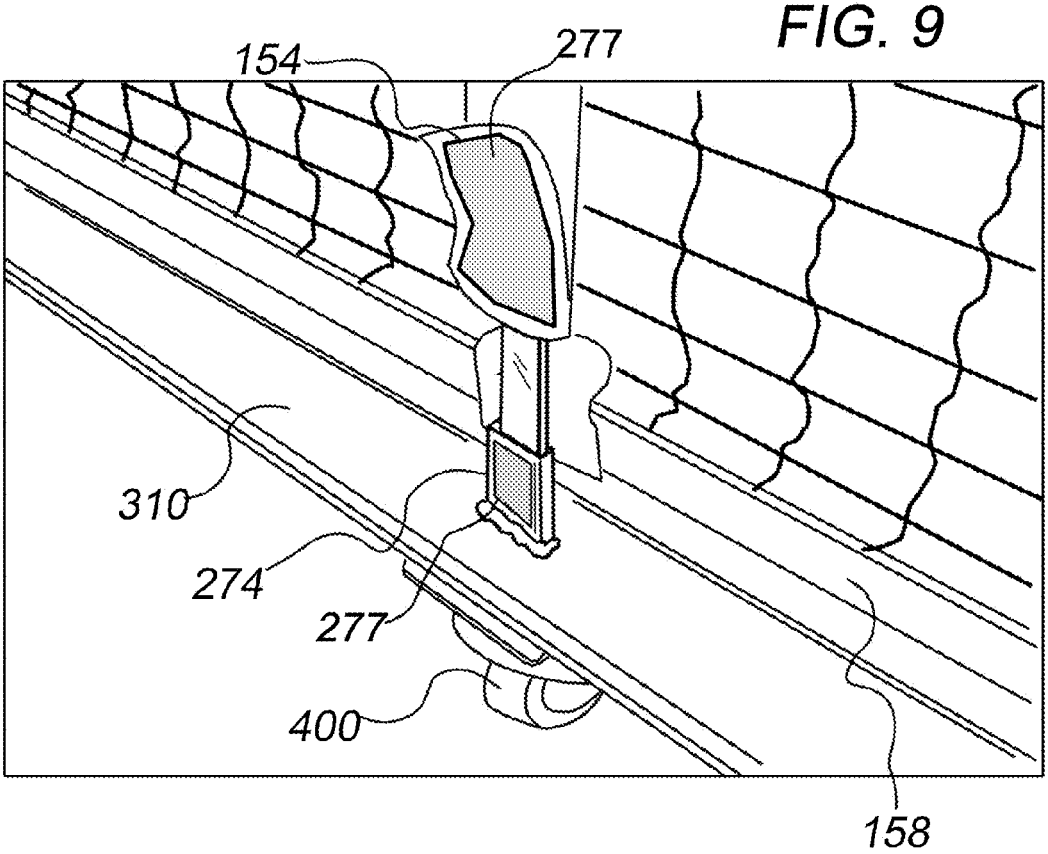
FIG. 9 is a perspective view of another embodiment showing a frame mid-section with retention and support member for a tensioning member and net tensioning strap 500

FIG. 8 is an cross-sectional detail view taken along lines 8'-8' of (FIG. 5*c*). The particular profile shown is not intended to be limiting. The width and height of the elliptic profile can vary depending on the particular implementation. The profile need not be a perfect ellipse.

It should be understood by those having skill in the art, that while due in part to economy and space considerations, each end-post assembly of the particular embodiment shown depicts a substantially horizontal leg member or base, it is not intended that the invention be necessarily limited one leg member or base for each sub-assembly. While preferably the end-post sub-assembly and the spacers are constructed of light weight steel channel, it can be of any material of sufficient rigidity and stability as would suggest itself to those skilled in the art. In some embodiments, the cross-member formed by the spacers is substantially straight (see FIGS. 5*a*, 5*b*), while in other embodiments, the formed cross-member is arched.

In view of the many possible embodiments to which the principles of the disclosed invention may be applied, it should be recognized that the illustrated embodiments are only preferred examples of the invention and should not be taken as limiting the scope of the invention.

What is claimed is:

1. A portable net support assembly structure for net and wall games comprising:

(1) a net with a vertical center strap with sleeve;

(2) a pair of end post sub-assemblies with each end post sub-assembly including a base member with a first connector, a second connector, and a post member for vertical attachment to the first connector;

(3) a cross-member having a substantially elliptical profile, including a set of self-aligning interconnectable sections of tubular channel wherein distal ends of the cross-member attach to the second connector of each end post sub-assembly for spanning distance between the end post assemblies and wherein the cross-member is supported raised from a playing surface, and wherein portions of the cross-member reside below a bottom edge of a stretched net.

2. The portable net support assembly according to claim 1 further comprising a net stabilizer including at least a retention and support member for a net tensioning member.

3. The portable net support assembly according to claim 1 further comprising casters supportive of at least the end post sub-assemblies for rolling the portable net assembly.

* * * * *